US008878769B2

(12) United States Patent
Miyashita

(10) Patent No.: US 8,878,769 B2
(45) Date of Patent: Nov. 4, 2014

(54) ELECTROPHORETIC DISPLAY APPARATUS AND METHOD OF DRIVING THE SAME

(75) Inventor: Takashi Miyashita, Ome (JP)

(73) Assignee: Casio Computer Co., Ltd., Tokyo (JP)

( * ) Notice: Subject to any disclaimer, the term of this patent is extended or adjusted under 35 U.S.C. 154(b) by 700 days.

(21) Appl. No.: 12/853,417

(22) Filed: Aug. 10, 2010

(65) Prior Publication Data

US 2011/0057871 A1 Mar. 10, 2011

(30) Foreign Application Priority Data

Sep. 9, 2009 (JP) ..... 2009-208289

(51) Int. Cl.

| | |
|---|---|
| ***G09G 3/34*** | (2006.01) |
| ***G09G 3/20*** | (2006.01) |
| ***G09G 1/00*** | (2006.01) |
| ***G09G 5/10*** | (2006.01) |

(52) U.S. Cl.

CPC ..... *G09G 3/344* (2013.01); *G09G 2310/063* (2013.01); *G09G 2320/0247* (2013.01); *G09G 2310/068* (2013.01); *G09G 2300/08* (2013.01); *G09G 2310/066* (2013.01)

USPC ..... 345/107; 345/214; 345/690; 345/55; 345/84

(58) Field of Classification Search

CPC ..... G02F 1/167; G09G 2300/08; G09G 2310/066; G09G 2310/063; G09G 2310/068; G09G 2320/0247; G09G 3/344

USPC ..... 345/107, 214, 690, 55, 84

See application file for complete search history.

(56) References Cited

U.S. PATENT DOCUMENTS

| | | | |
|---|---|---|---|
| 6,671,081 | B2 | 12/2003 | Kawai |
| 7,499,211 | B2 | 3/2009 | Suwabe et al. |
| 7,518,782 | B2 | 4/2009 | Maeda |
| 7,580,025 | B2 | 8/2009 | Nakai et al. |

(Continued)

FOREIGN PATENT DOCUMENTS

| | | | |
|---|---|---|---|
| JP | 2004-184435 | A | 7/2004 |
| JP | 2004-287425 | A | 10/2004 |

(Continued)

OTHER PUBLICATIONS

English Language Translation of JP 2004-287425; Published: Oct. 14, 2004.*

(Continued)

*Primary Examiner* — Dwayne Bost
*Assistant Examiner* — Nalini Mummalaneni
(74) *Attorney, Agent, or Firm* — Holtz, Holtz, Goodman & Chick PC

(57) ABSTRACT

An electrophoretic display apparatus includes a display unit, a signal voltage application circuit, and a common voltage application circuit. The display unit includes a first substrate having a first electrode formed thereon, a second substrate facing the first substrate and having a second electrode formed thereon, and a partition wall. A pixel space surrounded by the partition wall, the first substrate, and the second substrate contains dispersant suspending positively-charged particles and negatively-charged particles. The signal voltage application circuit applies a signal voltage to the first electrode. The signal voltage includes a write signal voltage to display an image on the display unit, and a post-write signal voltage which gradually changes from the write signal voltage to a hold signal voltage, the hold signal voltage maintaining a display state of the display unit. The common voltage application circuit applies a common voltage to the second electrode.

12 Claims, 5 Drawing Sheets

(56) References Cited

U.S. PATENT DOCUMENTS

| | | | | |
|---|---|---|---|---|
| 7,999,787 | B2 | 8/2011 | Amundson et al. | |
| 8,264,454 | B2 | 9/2012 | Kim et al. | |
| 2002/0021483 | A1* | 2/2002 | Katase | 359/267 |
| 2006/0038772 | A1* | 2/2006 | Amundson et al. | 345/107 |
| 2007/0070028 | A1* | 3/2007 | Zhou et al. | 345/107 |
| 2007/0247418 | A1 | 10/2007 | Nakai et al. | |
| 2008/0150887 | A1* | 6/2008 | Kim et al. | 345/107 |
| 2008/0151355 | A1* | 6/2008 | Suwabe et al. | 359/296 |
| 2009/0009445 | A1* | 1/2009 | Lee | 345/85 |

FOREIGN PATENT DOCUMENTS

| | | | |
|---|---|---|---|
| JP | 2005-43590 | A | 2/2005 |
| JP | 2005-115066 | A | 4/2005 |
| JP | 2006-133332 | A | 5/2006 |
| JP | 2007-72349 | A | 3/2007 |
| JP | 2007-507737 | A | 3/2007 |
| JP | 2007-102148 | A | 4/2007 |
| JP | 2007-127676 | A | 5/2007 |
| JP | 2007-206266 | A | 8/2007 |
| JP | 2008-33241 | A | 2/2008 |
| JP | 2008-225100 | A | 9/2008 |
| JP | 2009-122696 | A | 6/2009 |
| TW | 594974 | B | 6/2004 |
| TW | 200828236 | A | 7/2008 |

OTHER PUBLICATIONS

English Language Translation of JP 2004-184435; Published: Jul. 2, 2004.*

Japanese Office Action dated Apr. 12, 2011 (and English translation thereof) in counterpart Japanese Application No. 2009-208289.

Taiwanese Office Action dated May 22, 2013 (and English translation thereof) in counterpart Taiwanese Application No. 099130256.

* cited by examiner

ELECTROPHORETIC DISPLAY APPARATUS AND METHOD OF DRIVING THE SAME

CROSS-REFERENCE TO RELATED APPLICATIONS

This application is based upon and claims the benefit of priority from prior Japanese Patent Application No. 2009208289, filed Sep. 9, 2009, the entire contents of which are incorporated herein by reference.

BACKGROUND OF THE INVENTION

1. Field of the Invention

The present invention relates to an electrophoretic display apparatus and a method of driving the same.

2. Description of the Related Art

An electrophoretic display device is beginning to find application in such fields as electronic book readers, cellular phones, electronic shelf labels, and watches. The electrophoretic display device is capable of display easy on eyes because it can obtain a reflectivity, contrast, and angle of view close to those of paper. Since the electrophoretic display device has a memory property, the device consumes power only for display rewrite, and requires no more power once data is displayed. That is, the electrophoretic display device is a low power consumption display device. The electrophoretic display device also has a structure simpler than that of a liquid crystal display device or an organic electroluminescent display device. Hence, the display device is expected to be more flexible.

An electrophoretic display device using electrophoretic microcapsules disclosed in, for example, Jpn. Pat. Appln. KOKAI Publication No. 2007-507737 is known. The electrophoretic display device disclosed in Jpn. Pat. Appln. KOKAI Publication No. 2007-501737 uses microcapsules in which a dispersant, charged white particles, and oppositely-charged black particles that are charged to a polarity opposite to that of the charged white particles are sealed. In this electrophoretic display device, each microcapsule is sandwiched between electrodes. Jpn. Pat. Appln. KOKAI Publication No. 2007-507737 discloses a technique of making the particles in the microcapsules migrate in accordance with electric fields generated by the electrodes and thus causing the display device to perform black display or white display.

When charged particles and oppositely-charged particles are used as in the technique of the electrophoretic display device disclosed in Jpn. Pat. Appln. KOKAI Publication No. 2007-507737, attractive forces act between the particles. For this reason, the charged particles and the oppositely-charged particles readily cohere. Such cohesion of the particles sometimes leads to mixing of the colors of the charged particles and oppositely-charged particles. The color mixture is not preferable because it lowers the contrast of an image displayed on the electrophoretic display device. When the electric field applied to the electrophoretic display device for black display or white display is changed, the cohered particles sometimes cause an abrupt change of display reflectance. The abrupt change of display reflectance is perceived by the observer as an uncomfortable flicker at times.

BRIEF SUMMARY OF THE INVENTION

According to an aspect of the invention, an electrophoretic display apparatus includes a display unit including (i) a first substrate, (ii) a second substrate which faces the first substrate with a predetermined interval, (iii) at least one partition wall configured to form at least one boundary of at least one pixel space, the pixel space being surrounded by the partition wall, the first substrate and the second substrate, (iv) at least one first electrode formed on the first substrate in the pixel space, (v) a second electrode formed on the second substrate in the pixel space, (vi) positively-charged particles contained in the pixel space, (vii) negatively-charged particles contained in the pixel space, (viii) a thin film transistor including a source electrode, a gate electrode and a drain electrode, the source electrode being connected to the first electrode, (ix) a scanning line configured to supply, to the gate electrode, a scanning signal voltage for selectively turning the thin film transistor to an ON state, and (x) a signal line connected to the drain electrode to input a data signal voltage so as to cause the positively-charged particles and the negatively-charged particles to migrate; a scanning signal voltage application circuit configured to apply the scanning signal voltage to the scanning line; a data signal voltage application circuit configured to apply the data signal voltage to the signal line; and a common voltage application circuit configured to apply a common voltage to the second electrode, wherein the data signal voltage includes (i) a pre-write signal voltage which alternately repeats a positive voltage with respect to the common voltage and a negative voltage with respect to the common voltage, (ii) a write signal voltage to display an image on the display unit, and (iii) a post-write signal voltage which gradually changes from the write signal voltage to a hold signal voltage, the hold signal voltage maintaining a display state of the display unit, and (iv) the hold signal voltage; wherein the data signal voltage application circuit applies the pre-write signal voltage during a prepulse operation period, applies the write signal voltage during a write operation period, applies the post write-signal voltage during a write end operation period, and applies the hold signal voltage during a hold operation period; and wherein the scanning signal voltage application circuit applies a predetermined scanning signal voltage for turning off the thin film transistor to the scanning line during a period between (i) a transition of the data signal voltage to the hold signal voltage and (ii) a next transition of the data signal voltage to the pre-write signal voltage, the predetermined scanning signal voltage being different in potential from the hold signal voltage.

According to an aspect of the invention, a method of driving an electrophoretic display apparatus including a display unit configured to display an image by electro-phoretic charged particles in a dispersant contained in at least one pixel space, includes applying a common voltage to a common electrode in the pixel space; applying, to the pixel electrode in the pixel space, a pre-write signal voltage which alternately repeats a positive voltage with respect to the common voltage and a negative voltage with respect to the common voltage, the pre-write signal voltage being applied during a prepulse operation period; applying a write signal voltage for displaying the image to at least one pixel electrode facing the common electrode in the pixel space, the write signal voltage being applied during a write operation period; applying a post-write signal voltage to the pixel electrode, the post-write signal voltage gradually changing from the write signal voltage to a hold signal voltage maintaining a display state of the display unit, the post-write signal voltage being applied during a write end operation period; applying the hold signal voltage to the pixel electrode, the hold signal voltage being applied during a hold operation period; and applying a predetermined scanning signal voltage for turning off a thin film transistor to a scanning line during a period between (i) a transition of the data signal voltage to the hold signal voltage and (ii) a next transition of the data signal voltage to the pre-write signal voltage, the predetermined scanning signal voltage being different in potential from the hold signal voltage.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

FIG. 6 is a timing chart of driving an electrophoretic display apparatus according to a modification of the embodiment of the present invention.

DETAILED DESCRIPTION OF THE INVENTION best mode for carrying out the present invention will now be described with reference to the accompanying drawings. Various limitations technically preferable for practicing the present invention are given to the embodiments to be described below. However, the scope of the invention is not limited to the embodiments and illustrated examples.

Figure 1:
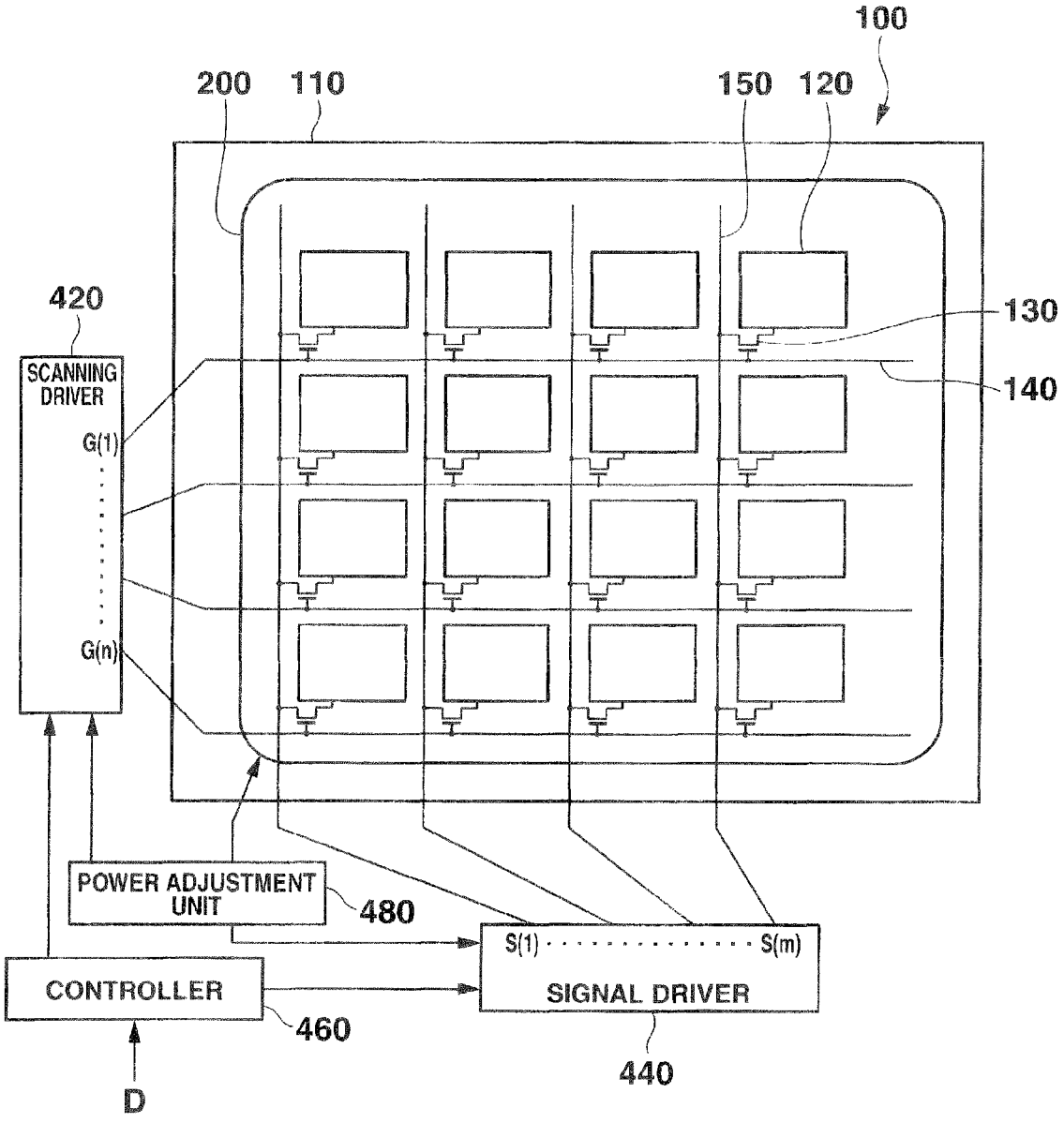
FIG. 1 is schematic view showing an example of the arrangement of an electrophoretic display apparatus according to an embodiment of the present invention.

An embodiment of the present invention will be described with reference to the accompanying drawings. FIG. 1 is a schematic view showing the arrangement of an electrophoretic display apparatus according to this embodiment. As shown in FIG. 1, the electrophoretic display apparatus includes a display panel 100, a scanning driver 420, a signal driver 440, a controller 460, and a power adjustment unit 480. The display panel 100 displays an image based on image data D. The display panel 100 includes a display device having an electrophoretic layer sandwiched between a pixel-side substrate 110 and a COM substrate 200.

A plurality of scanning lines 140 (G(j) (j=1, 2, . . . , n)) and a plurality of signal lines 150 (S(i) (i=1, 2, . . . , m)) run so as to intersect each other on the pixel-side substrate 110. A pixel electrode 120 is arranged at each of positions corresponding to the intersections between the scanning lines 140 and the signal lines 150. The pixel electrodes 120 are electrically connected to the scanning lines 140 (G(j)) and the signal lines 150 (S(i)) via thin-film transistors (TFTs) 130. Hence, m pixel electrodes 120 are connected to each scanning line, whereas n pixel electrodes 120 are connected to each signal line. FIG. 1 schematically illustrates the display panel 100 in which n=4, and m=4, for the sake of simplicity. The scanning lines 140 are connected to the scanning driver 420. The signal lines 150 are connected to the signal driver 440. The scanning driver 420 and the signal driver 440 are connected to the controller 460. The power adjustment unit 480 is connected to the COM substrate 200. The power adjustment unit 480 is also connected to the scanning driver 420 and the signal driver 440.

Figure 2:
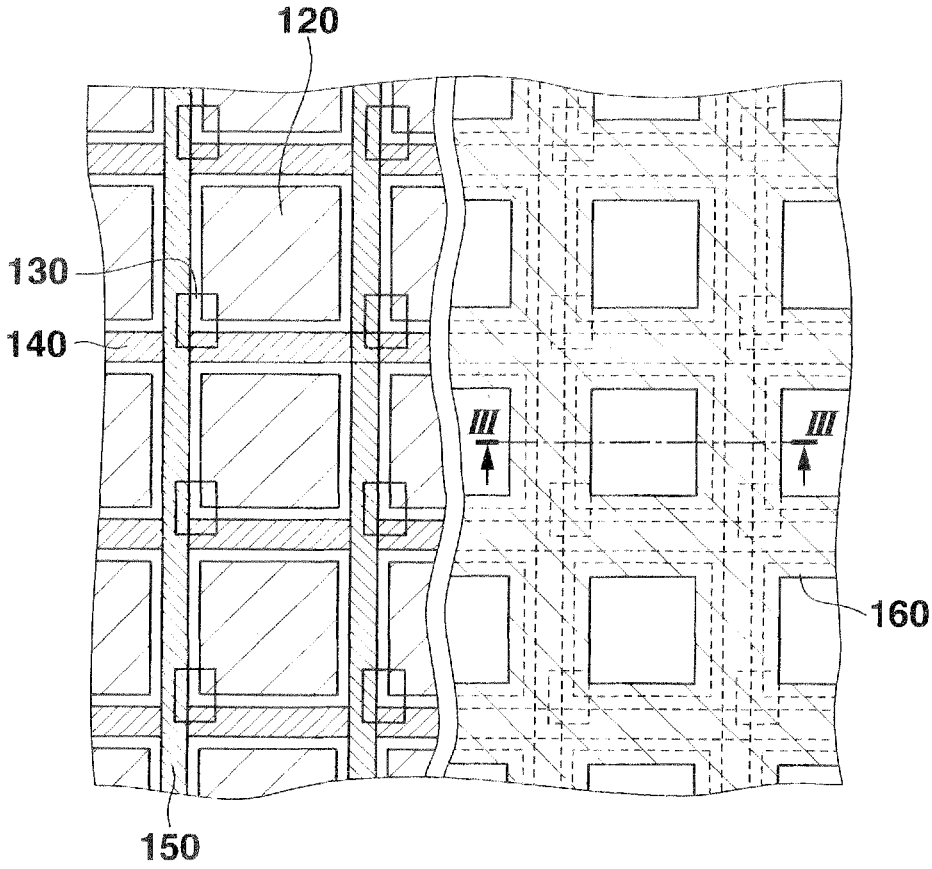
FIG. 2 is a schematic planar view showing an example of the structure of the electrophoretic display apparatus according to the embodiment of the present invention.
Figure 3:
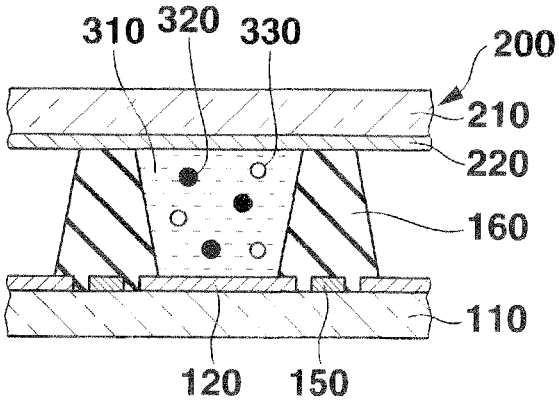
FIG. 3 is a schematic sectional view showing an example of the structure of the electrophoretic display apparatus according to the embodiment of the present invention.

An example of the structure of the display panel 100 according to this embodiment will further be described with reference to FIGS. 2 and 3. FIG. 2 is a planar view of the display portion of the display panel 100, and FIG. 3 is a sectional view taken along line in FIG. 2. The pixel electrodes 120 are formed on the pixel-side substrate 110. The pixel-side substrate 110 can include, for example, glass or the like, and the pixel electrodes 120 can include, for example, indium tin oxide (ITO) layers. As shown in FIGS. 2 and 3, the pixel electrodes 120 are formed so that one pattern corresponds to one pixel. The pixel electrodes 120 are connected to the source electrodes of the TFTs 130 each serving as a switching element. The scanning lines 140 are connected to the gate electrodes of the TFTs 130. The signal lines 130 are connected to the drain electrodes of the TFTs 130. The scanning lines 140 and the signal lines 150 intersect each other, as described above. Although not illustrated in FIGS. 2 and 3, compensatory capacity electrodes are formed between the pixel-side substrate 110 and the pixel electrodes 120. Each compensatory capacity electrode is connected to a compensatory capacity line. Microribs 160 are formed on the scanning lines 140, the signal lines 150, the compensatory capacity lines, the TFTs 130, and parts of the pixel electrodes 120 so as to surround each pixel electrode 120 and expose the upper surfaces of the pixel electrodes 120.

The COM substrate 200 is arranged on the upper surfaces of the microribs 160. The COM substrate 200 is prepared by forming a common electrode 220 on a transparent substrate 210 such as a transparent glass substrate. The common electrode 220 includes a transparent conductive layer such as an ITO layer. The common electrode 220 is connected to the power adjustment unit 480. Positively-charged black particles 320 and negatively-charged white particles 330 suspended in a dispersant 310 are sealed in each pixel compartment surrounded by the pixel-side substrate 110, the COM substrate 200, and the microribs 160, as shown in FIG. 3. The positively-charged black particles 320 can include, for example, carbon, and the negatively-charged white particles 330 can include, for example, titanium oxide ($TiO_2$). The positively-charged black particle 320 can have a diameter of, for example, 5.0 μm or less. The negatively-charged white particle 330 can have a diameter of, for example, 0.3 μm or less. As the dispersant 310, a dispersion medium having a dielectric constant lower than those of the positively-charged black particles 320 and the negatively-charged white particles 330 is usable.

As described above, for example, the pixel-side substrate 110 can function as a first substrate. For example, the pixel electrode 120 can function as a first electrode. For example, the microribs 160 can function as a partition wall. For example, the transparent substrate 210 can function as a second substrate. For example, the common electrode 220 can function as a second electrode. For example, the dispersant 310 can function as a dispersant. For example, the positively-charged black particles 320 can function as positively-charged particles. For example, the negatively-charged white particles 330 can function as negatively-charged particles. For example, the scanning driver 420 can function as a scanning signal voltage application circuit and the signal driver 440 can function as a data signal voltage application circuit. For example, the power adjustment unit 480 can function as a common voltage application circuit.

The operation of the electrophoretic display apparatus according to this embodiment will be described below. Under the control of the controller 460, the scanning driver 420 shown in FIG. 1 sequentially supplies scanning signals to the scanning lines 140 (G(j)) of the display panel 100 using a power supplied from the power adjustment unit 480. When ON voltages are applied to the scanning lines 140, the TFTs 130 connected to the scanning lines 140 are turned on. At this time, the signal driver 440 supplies data signals to the signal lines 150 (S(i)) using a power supplied from the power adjustment unit 180 under the control of the controller 460. The data signals supplied to the signal lines 150 (S(i)) are supplied to the corresponding pixel electrodes 120 via the TFTs 130 turned on by scanning signals. The data signals generate pixel voltages.

In this way, the scanning driver 420 sequentially supplies the scanning signals to the scanning lines 140. Simultaneously, the signal driver 440 supplies the data signals to the signal lines 150 connected to the pixel electrodes 120 to which pixel voltages should be applied. This makes it possible to apply she pixel voltages to desired pixel electrodes 120 of all the pixel electrodes 120. On the other hand, the power adjustment unit 480 maintains the common electrode 220 at a predetermined voltage, for example, 0 V. The compensatory capacity electrodes located under the pixel electrodes 120 are also maintained at an equi-voltage to the common electrode 220 by the power adjustment unit 480. Hence, the pixel electrodes 120 and the compensatory capacity electrodes form storage capacitors. The storage capacitors contribute to retain the pixel voltages based on the data signals supplied to the pixel electrodes 120.

Figure 4:
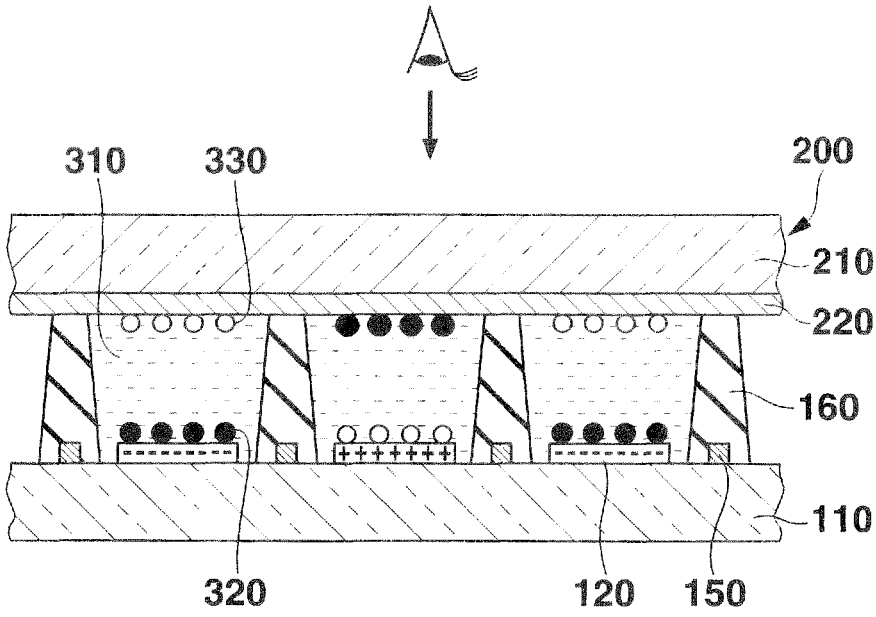
FIG. 4 is a sectional view for explaining the display principle of the electrophoretic display apparatus according to the embodiment of the present invention.

FIG. 4 shows the display principle of the electrophoretic display apparatus according to this embodiment. When pixel voltages are applied via the pixel electrodes 120, electric fields are generated between the pixel electrodes 120 and the common electrode 220. In accordance with the generated electric fields, the positively-charged black particles 320 move to each electrode having negative charges, and the negatively-charged white particles 330 move to each electrode having positive charges in the dispersant 310. As a result, when a user observes the electrophoretic display device from the side of the COM substrate 200 in the direction of the black arrow in FIG. 4, the pixels look as follows. A pixel in which the positively-charged black particles 320 gather on the common electrode 220, i.e., a pixel in which a positive voltage is applied to the pixel electrode 120 looks black (middle pixel in FIG. 4). Conversely, a pixel in which the negatively-charged white particles 330 gather on the common electrode 220, i.e., a pixel in which a negative voltage is applied to the pixel electrode 120 looks white (right and left pixels in FIG. 4). That is, each pixel of the display panel 100 can display black or white. The pixels for displaying black or white are arranged in a matrix. Hence, the electrophoretic display apparatus of this embodiment can display a desired image including two colors by combining the black and white displayed by the pixels.

Figure 5:
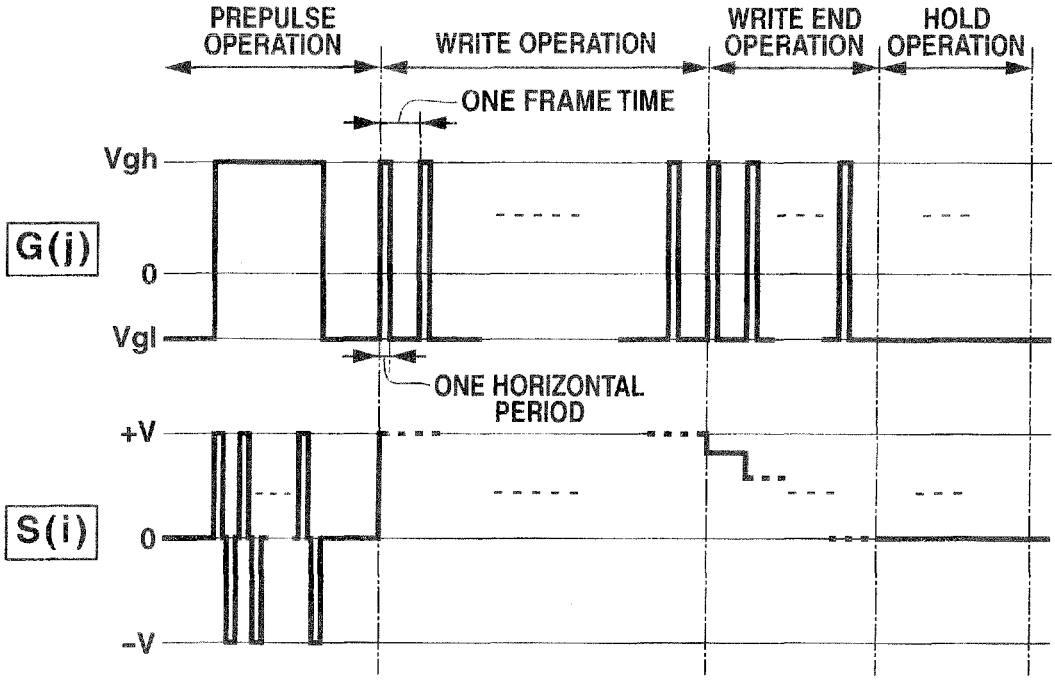
FIG. 5 is a timing chart of driving the electrophoretic display apparatus according to the embodiment of the present invention.

A method of driving the electrophoretic display apparatus according to the embodiment will be explained. The driving operation of the electrophoretic display apparatus is divided into four steps. The first is a prepulse operation of eliminating cohesion of the positively-charged black particles 320 and the negatively-charged white particles 330. The second is a write operation of causing the electrophoretic display apparatus to display a desired image. The third is a write end operation of ending the write operation. The fourth is a hold operation of maintaining the display of the desired image written in the electrophoretic display apparatus by the write operation. FIG. 5 is a timing chart of driving the TFTs 130 of the electrophoretic display apparatus. Referring to FIG. 5, the voltage of a jth scanning line 140G(j) is shown on the upper side, and the voltage of an ith signal line 150S(i) is shown on the lower side.

First, the prepulse operation is performed. The prepulse operation prevents the positively-charged black particles 320 and the negatively-charged white particles 330 from moving between the pixel electrodes 120 and the common electrode 220 while remaining cohered. In the prepulse operation, pixel voltages are applied to all pixels. It is therefore unnecessary to apply a pixel voltage to each pixel electrode 120 on each scanning line. The pixel voltages are applied to the pixel electrodes 120 of all pixels at once. To turn all TFTs 130 on, the scanning driver 420 switches the scanning signals to be supplied to all scanning lines 140 from a gate off level Vgl to a gate on level Vgh. While the scanning signals of gate on level Vgh are being supplied to the scanning lines 140, the signal driver 440 alternately applies a pulse having a predetermined voltage +V with respect to the common voltage and a pulse having a predetermined voltage −V with respect to the common voltage to all signal lines 150 a predetermined number of times.

Figure 6:
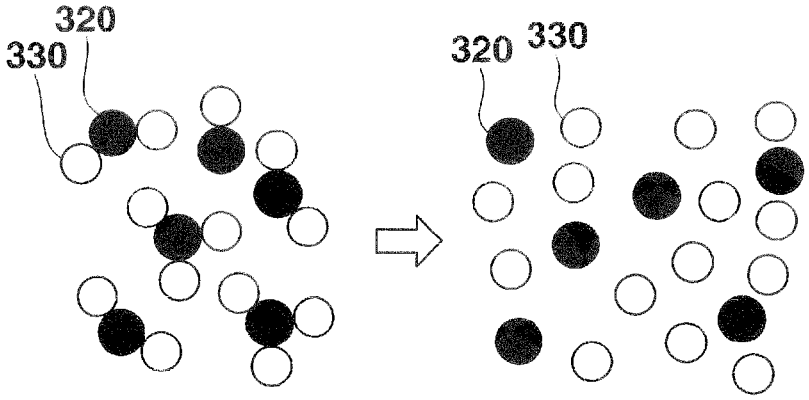
FIG. 6 is a schematic view showing eliminating the cohesion of positively-charged black particles and negatively-charged white particles by a prepulse operation.

With the prepulse operation, a force for producing a back-and-forth motion is applied to the positively-charged black particles 320, whereas a force for producing a back-and-forth motion in a direction opposite to the positively-charged black particles 320 is applied to the negatively charged white particles 330. As a result, the positively charged black particles 320 and the negatively-charged white particles 330, which cohered before the prepulse operation as shown in the left schematic view of FIG. 6, get loose as shown in the right schematic view of FIG. 6.

Next, the write operation is performed. The scanning driver 420 sequentially switches the scanning signals to be supplied to the scanning lines 140 (G(j)) from the gate off level Vgl to the gate on level Vgh. The time applying Vgh to each row (each scanning line 140(G(j))) corresponds to one horizontal period, i.e., period in which the scanning signals for one row (one scanning line) are supplied. When the voltage of the scanning line 140G(j) changes to Vgh, the TFTs 130 connected to the scanning line 140G(j) are turned on. At this time, the signal driver 440 supplies data signals to the signal lines 150 (S(i)). The data signals supplied to the signal lines 150 (S(i)) are supplied to the corresponding pixel electrodes 120 via the TFTs 130 turned on by the scanning signals. In this way, the scanning signals are sequentially supplied to the scanning lines 140, and the data signals are simultaneously supplied to the signal lines 150 to which the pixel voltages should be applied, thereby applying the pixel voltages to desired pixel electrodes 120 of all pixel electrodes. On the other hand, the common electrode 225 is maintained at a predetermined voltage. The voltage differences between the pixel electrodes 120 and the common electrode 220 cause the positively-charged black particles 320 and the negatively-charged white particles 330 to migrate. However, applying the pixel voltages only once may not suffice for sufficient migration of the positively-charged black particles 320 and the negatively-charged white particles 330. The pixel voltage application is preferably repeated a predetermined number of times for each frame time. Storage capacitances formed by the pixel electrodes 120 and the compensatory capacity electrodes at this time assist in retaining the voltages of the pixel electrodes 120 during a time no scanning signals and data signals are being applied. As the positively-charged black particles 320 and the negatively-charged white particles 330 move, charges accumulated in the storage capacitors are consumed. Hence, the compensatory capacity electrodes are preferably as large as possible.

Figure 7:
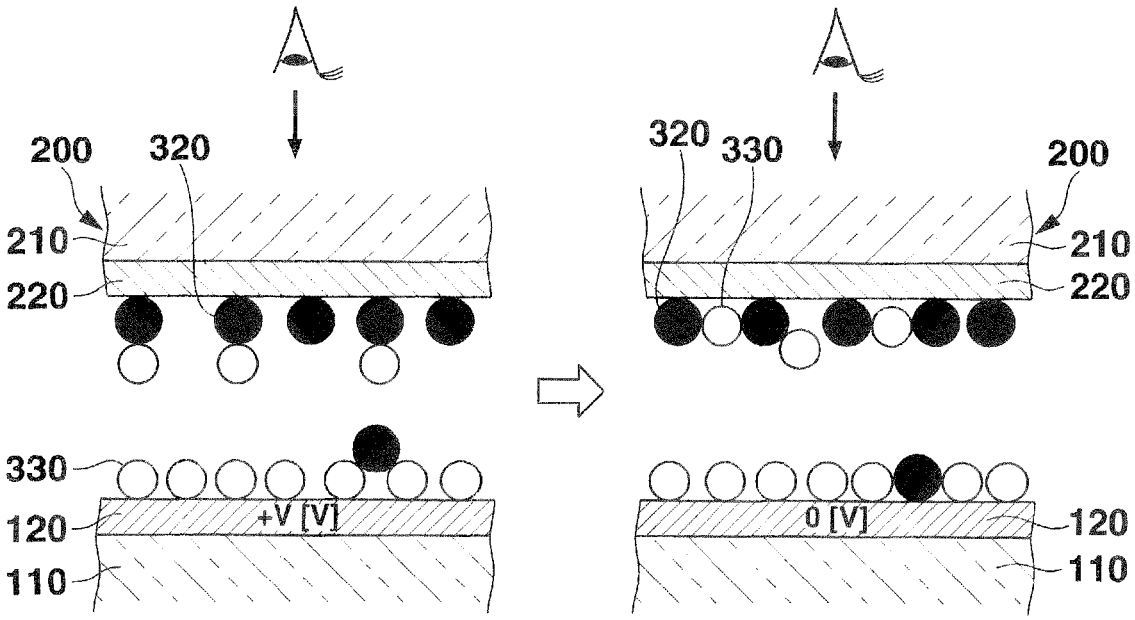
FIG. 7 is a view for explaining a change of black display caused by the behavior of particles before and after the stop of pixel voltage application.

Even when the prepulse operation is performed before the write operation, the particles may remain cohered or cohere again during the write operation. In this case, the particles may migrate while remaining cohered in the write operation. FIG. 7 is a schematic view showing this state. The observer sees the electrophoretic display apparatus from the side of the COM substrate 200 in the direction of the black arrow in FIG. 7. For example, while a positive pixel voltage is being applied, the particles are arranged in the pixel space in accordance with an electric field, as shown on the left side of FIG. 7. As a result, the black particles are observed in the pixel so that the pixel looks black. However, when the pixel voltage application stops, the white particles cohered to the black particles may move to the side of the COM substrate 200, as shown on the right side of FIG. 7. In this case, the observer sees a state in which a small number of white particles mix among the black particles. For this reason, when the pixel voltage application stops, the observer recognizes a decrease of blackness. If such decrease of blackness abruptly occurs, the observer perceives an uncomfortable flicker in the display.

To prevent this, in this embodiment, the write end operation is performed after the write operation to gradually decrease the pixel voltage, as shown in FIG. 5. More specifically, while the voltage of the scanning line 140G(j) is Vgh, the signal driver 440 makes the signal lines 150 (S(i)) closer to the voltage of the hold operation (the voltage of the COM electrode 220) such as 0 V in, e.g., each frame time gradually over a plurality of frame periods. As a result, the speed of color change caused by the above-described mutual movement of cohered particles is reduced. Since the color change speed is reduced by the write end operation, the observer hardly perceives an uncomfortable flicker in the display of the electrophoretic display apparatus according to this embodiment.

Finally in the hold operation, the scanning driver 420 sets the scanning signals to the gate off level Vgl, and the signal driver 440 sets the data signals to 0 V. Even when the scanning signals are at the gate off level Vgl, and the data signals are at 0 V, the particles remain on the electrodes due to attractive forces such as van der Waals forces acting between the particles and the electrodes. As a result, the electrophoretic display apparatus maintains display of the written image.

As described above, for example, the prepulse operation can be executed as applying a pre-write signal voltage. For example, the write operation can be executed as applying a write signal voltage. For example, the write end operation can be executed as applying a post-write signal voltage. For example, the hold operation can be executed as applying a hold signal voltage.

In this embodiment, an example has been described in which the positively-charged black particles and the negatively-charged white particles are sealed in each pixel compartment. However, the charge states of the black and white particles may be reversed. In addition, the particles can have any other colors.

The pixel-side substrate of this embodiment may be a non-transparent substrate such as a class substrate, metal substrate, plastic substrate, or film substrate. The TFT may be a low-temperature p-SiTFT, μc-SiTFT, oxide (e.g., ZnO or InGaZnO) TFT, or organic TFT. The pixel electrode 120 has been described as, for example, an ITO layer. However, since the electrophoretic display panel is a reflective display panel, unlike a liquid crystal display panel, the pixel electrodes 120 need not always be transparent. Hence, the pixel electrodes 120 may be non-transparent electrodes.

To realize the memory property, i.e., maintaining display without consuming power after an image has been displayed on the display device, which is one of the characteristics of the electrophoretic display device, the leakage current of the TFTs 130 needs to be as small as possible. To do this, the electrophoretic display panel may include a dual-gate structure which connects two TFTs serving as switching elements in series to increase the resistance value.

The electrophoretic display apparatus according to this embodiment loosens the cohesion of the positively-charged black particles 320 and the negatively-charged white particles 330 by the prepulse operation. This loosening allows the electrophoretic display apparatus to prevent any decrease in the contrast of the image displayed on it caused by color mixture of black and white. The electrophoretic display apparatus can also shorten the prepulse operation time by performing the prepulse operation in all pixels at once, instead of performing the prepulse operation for each scanning line.

After the end of the write operation, the electrophoretic display apparatus according to this embodiment performs the write end operation to gradually decrease the pixel voltage. The write end operation can reduce the speed of color change caused by mutual movement of cohered particles after the end of the write operation. As a result, the electrophoretic display apparatus can perform display in which an uncomfortable flicker is hardly perceivable by the observer.

Figure 8:
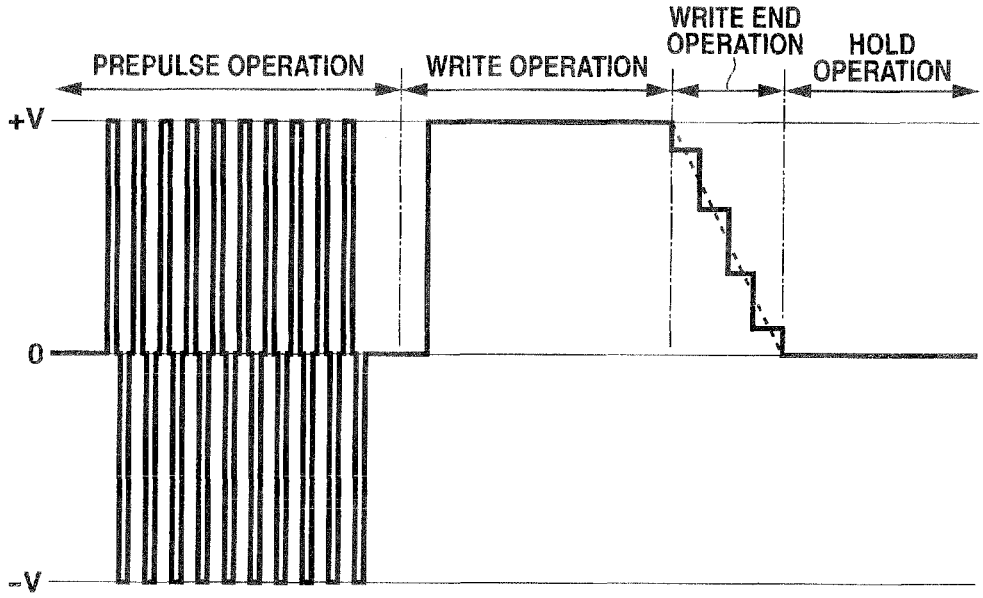

A modification of the embodiment will be described next. In this modification, only the differences from the first embodiment will be explained. In the first embodiment, an active matrix driving method using the TFTs 130 has been exemplified. However, a segment driving method is also usable. To use the segment driving method, each segment of the electrophoretic display apparatus has a compartment surrounded by the pixel, electrode 120 connected to the drivers, the common electrode 220, and the microribs 160, as in the first embodiment. The dispersant 310, the positively-charged black particles 320, and the negatively-charged white particles 330 are sealed in the compartment. In this electrophoretic display apparatus, voltages as shown in FIG. 8 are applied to the pixel electrode of each segment.

First, as the prepulse operation, a pulse having a predetermined voltage +V with respect to the common voltage and a pulse having a predetermined voltage −V with respect to the common voltage are alternately applied to each segment a predetermined number of times. Next, as the write operation, a voltage for write is applied to each segment. As the write end operation, the voltage applied to each segment in the write operation is gradually decreased. In the write end operation, the voltage may decrease stepwise as indicated by the solid line in FIG. 8, or gradually as indicated by the dotted line in FIG. 8. Finally, as the hold operation, the voltage applied to each segment is maintained at, for example, 0 V.

According to this modification, the operation of each unit and the behavior of charged particles are the same as in the first embodiment. It is therefore possible to obtain the same effects as in the first embodiment.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An electrophoretic display apparatus comprising:

a display unit including:

(i) a first substrate, (ii) a second substrate which faces the first substrate with a predetermined interval, (iii) at least one partition wall configured to form at least one boundary of at least one pixel space, the pixel space being surrounded by the partition wall, the first substrate and the second substrate, (iv) at least one first electrode formed on the first substrate in the pixel space, (v) a second electrode formed on the second substrate in the pixel space, (vi) positively-charged particles contained in the pixel space, (vii) negatively-charged particles contained in the pixel space, (viii) a thin film transistor including a source electrode, a gate electrode and a drain electrode, the source electrode being connected to the first electrode, (ix) a scanning line configured to supply, to the gate electrode, a scanning signal voltage for selectively turning the thin film transistor to an ON state, and (x) a signal line connected to the drain electrode to input a data signal voltage so as to cause the positively-charged particles and the negatively-charged particles to migrate;

a scanning signal voltage application circuit configured to apply the scanning signal voltage to the scanning line;

a data signal voltage application circuit configured to apply the data signal voltage to the signal line; and a common voltage application circuit configured to apply a common voltage to the second electrode, wherein the data signal voltage includes:

(i) a pre-write signal voltage which alternately repeats a positive voltage with respect to the common voltage and a negative voltage with respect to the common voltage, (ii) a write signal voltage to display an image on the display unit, (iii) a post-write signal voltage which gradually decreases from the write signal voltage to a hold signal voltage, the hold signal voltage maintaining a display state of the display unit, and (iv) the hold signal voltage, wherein the data signal voltage application circuit applies the pre-write signal voltage during a prepulse operation period, applies the write signal voltage during a write operation period, applies the post-write signal voltage during a write end operation period, and applies the hold signal voltage during a hold operation period, and wherein the scanning signal voltage application circuit sequentially switches the scanning signal voltage to the scanning line from a gate off level voltage to a gate on level voltage for one horizontal period during the write operation period and the write-end operation period, and applies the gate off level scanning signal voltage for turning off the thin film transistor to the scanning line during a period between (i) a transition of the data signal voltage to the hold signal voltage, and (ii) a next transition of the data signal voltage to the pre-write signal voltage, the gate off level scanning signal voltage being lower in potential than the hold signal voltage.

2. The apparatus according to claim 1, wherein the data signal voltage application circuit applies the post-write signal voltage over a plurality of frame periods.

3. The apparatus according to claim 1, wherein:

the at least one first electrode comprises a plurality of first electrodes, the at least one pixel space comprises a plurality of pixel spaces, the at least one partition wall comprises a plurality of partition walls which form a plurality of boundaries of the plurality of pixel spaces, the pixel spaces each include respective ones of the plurality of first electrodes formed on the first substrate, and the data signal voltage application circuit applies the pre-write signal voltage to the plurality of first electrodes at once.

4. The apparatus according to claim 1, wherein the positively-charged particles comprise surfaces with a color different from a color of surfaces of the negatively-charged particles.

5. The apparatus according to claim 4, wherein the color of the surfaces of the positively-charged particles is black, and the color of the surfaces of the negatively-charged particles is white.

6. The apparatus according to claim 5, wherein each of the positively-charged particles has a diameter larger than a diameter of each of the negatively-charged particles.

7. The apparatus according to claim 1, wherein the at least one first electrode comprises a plurality of first electrodes, and wherein the partition wall rises from upper surfaces of the thin film transistor, the scanning line, and the signal line toward the second substrate so as to surround a respective one of the first electrodes to partition a plurality of pixels including the plurality of first electrodes formed on the first substrate.

8. The apparatus according to claim 1, wherein the display unit further includes a dispersant contained in the pixel space.

9. The apparatus according to claim 8, wherein the dispersant has a dielectric constant lower than dielectric constants of the positively-charged particles and the negatively-charged particles.

10. The apparatus according to claim 1, wherein the hold signal voltage is 0 V.

11. A method of driving an electrophoretic display apparatus including a display unit configured to display an image by electrophoretic charged particles in a dispersant contained in at least one pixel space, the method comprising:

applying a common voltage to a common electrode in the pixel space;

applying, to a pixel electrode in the pixel space, a pre-write signal voltage which alternately repeats a positive voltage with respect to the common voltage and a negative voltage with respect to the common voltage, the pre-write signal voltage being applied during a prepulse operation period;

applying a write signal voltage for displaying the image to the pixel electrode facing the common electrode in the pixel space, the write signal voltage being applied during a write operation period;

applying a post-write signal voltage to the pixel electrode, the post-write signal voltage gradually decreasing from the write signal voltage to a hold signal voltage maintaining a display state of the display unit, the post-write signal voltage being applied during a write end operation period;

applying the hold signal voltage to the pixel electrode, the hold signal voltage being applied during a hold operation period; and sequentially switching a scanning signal voltage applied to a scanning line from a gate off level voltage to gate on level voltage for one horizontal period during the write operation period and the write-end operation period, and applying the gate off level voltage for turning off a thin film transistor to the scanning line during a period between (i) a transition of the data signal voltage to the hold signal voltage and (ii) a next transition of the data signal voltage to the pre-write signal voltage, the gate off level voltage being lower in potential than the hold signal voltage.

12. The method according to claim 11, wherein:

the pixel electrode comprises a plurality of pixel electrodes, the pixel space comprises a plurality of pixel spaces each including a respective one of the plurality of pixel electrodes, and the pre-write signal voltage is applied to the plurality of pixel electrodes at once.

* * * * *